US006401411B1

(12) United States Patent
Maglio, Jr.

(10) Patent No.: US 6,401,411 B1
(45) Date of Patent: Jun. 11, 2002

(54) POST BASE

(75) Inventor: Louis A. Maglio, Jr., Medfield, MA (US)

(73) Assignee: Walpole Woodworkers, Inc., Walpole, MA (US)

( * ) Notice: Subject to any disclaimer, the term of this patent is extended or adjusted under 35 U.S.C. 154(b) by 0 days.

(21) Appl. No.: 09/586,491

(22) Filed: Jun. 2, 2000

(51) Int. Cl.[7] ..... E02D 27/00

(52) U.S. Cl. ..... 52/297; 52/296; 52/70; 52/169.13; 52/101

(58) Field of Search ..... 52/101, 165, 169.13, 52/170, 296, 297; 249/13, 51, 143

(56) References Cited

U.S. PATENT DOCUMENTS

| | | | | |
|---|---|---|---|---|
| 546,161 | A | | 9/1895 | Kimball |
| 771,042 | A | | 9/1904 | Calkins |
| 822,131 | A | * | 5/1906 | Hyder |
| 976,879 | A | * | 11/1910 | Hughs |
| 1,234,893 | A | * | 7/1917 | Fridley |
| 1,433,621 | A | * | 10/1922 | Hutton |
| 1,606,697 | A | | 11/1926 | Dean |
| 1,711,178 | A | * | 4/1929 | Sague |
| 2,242,266 | A | * | 5/1941 | Scales |
| 2,978,780 | A | * | 4/1961 | Clarkson |
| 3,108,403 | A | | 10/1963 | Jackson |
| 3,166,871 | A | | 1/1965 | Simison |
| 3,593,480 | A | * | 7/1971 | Bouchillon |
| 4,673,157 | A | * | 6/1987 | Wells |
| 5,090,165 | A | | 2/1992 | Kenny |
| 5,097,641 | A | * | 3/1992 | Hand et al. |
| 5,271,203 | A | * | 12/1993 | Nagle |
| 5,303,523 | A | * | 4/1994 | Hand et al. |
| 5,503,371 | A | | 4/1996 | Bies |
| 5,720,134 | A | | 2/1998 | Kurtz |
| 5,832,675 | A | * | 11/1998 | Zuares ..... 52/60 |
| 6,098,353 | A | * | 8/2000 | Stanfiled |

OTHER PUBLICATIONS

Walpole Woodworkers, Inc. used a cylindrical non–tapered plastic sonotube filled with concrete and having a U–shaped metal bracket protruding from the concrete. The tube was buried in the ground and a fence post was mounted on the bracket. This was done prior to Jun. 2, 1999 (Oral Communication).

* cited by examiner

*Primary Examiner*—Robert Canfield
(74) *Attorney, Agent, or Firm*—Fish & Richardson P.C.

(57) ABSTRACT

A post base has an upwardly-tapering portion. The base is designed to be at least partially buried in the ground.

30 Claims, 6 Drawing Sheets

POST BASE

TECHNICAL FIELD

This invention relates to the construction of posts, and more particularly to posts with bases that are buried in the ground.

BACKGROUND

Wooden posts, for example those used in the construction of fences, are desirable in the construction of fences and the like. Typically, such posts are buried in the ground to a depth sufficient to provide the requisite stability. However, posts buried in the ground can suffer from the detrimental effects of moisture, decay, rotting, and pests (such as termites), which cause deterioration and shorten the useful lifespan of wooden posts. Further, posts buried in the ground may be susceptible to frost heave, which can cause posts to become loosened or dislodged.

SUMMARY

The invention, in one aspect, features a post base having an upwardly-tapering portion that is at least partially surrounded by a shell. Preferably, this base also includes a non-tapering portion adjacent to and axially below the upwardly-tapering portion.

In another aspect, the invention features a post base having an upwardly-tapering upper portion and a non-tapered lower portion.

A post, for example, a wooden post, may be attached to the base. Preferably, the post is attached by a rod received within openings in the post and in the upwardly-tapering portion of the base. Preferably, the rod is connected with an adhesive, although friction fit with fasteners, such as, screws, bolts, rivets, threads, interlocking members, or the like, may also be used.

The upwardly-tapering portion may have any suitable tapering profile, for example it may be frustum-shaped, pyramidal, conical, or have curved sides that are either concave or convex. However, the upwardly-tapering portion may have non-tapering or downwardly-tapering sections. The upwardly-tapering portion and the non-tapering portion may have a uniform cross-sectional shape throughout its extent, or it may combine several different shapes. The upwardly-tapering portion and the non-tapering portion may have cross-sectional shapes that are the same or different. For example, the upwardly-tapering portion and/or the non-tapering portion may have cross-sectional shapes that are rounded, ovoid, circular, triangular, quadrilateral, rectangular, square, or have any number of sides.

Preferably, the base includes a shield that projects laterally and/or downwardly from the base. The shield helps to deter termites and other pests.

The base may comprise a massive material such as concrete. In embodiments that include both an upwardly tapering upper portion and a non-tapering lower portion, both the upwardly-tapering portion and the non-tapering portion may include massive material. Preferably, the base comprises a shell having both tapering and non-tapering portions wherein only the tapering portion is filled with massive material, while the non-tapering portion is not so filled. In this way, the post base may be relatively lighter, so that it is easier for an installer to lift and handle the base. Even when the non-tapering portion is not filled with massive material, it nevertheless provides structural stability when the base is buried in the ground. Preferably, the shell contains inward projections that may be connected to indentations in a massive member or in the material held within the shell. Preferably, the indentations are formed by contours in the shell, so that the shell has a uniform thickness throughout. This design simplifies the construction if the shell is made, for example, by injection molding of a plastic. The contours may be either rounded or angled. Alternately, the indentations may comprise baffles or ribs that protrude inwardly from the shell.

Embodiments of the invention may include one or more of the following advantages.

The device provides a solid and secure foundation for the attachment of posts. The tapering shape of the device anchors it firmly in the ground and helps the base to resist frost heave. Using a pipe with predetermined dimensions within the base provides a good fit between the base and a connecting member, such as a rod. Embodiments in which the shell extends around the top of the upper portion and/or the bottom of the lower portion have additional strength and rigidity. The shell may be constructed by injection molding of a plastic.

The device is durable. The device resists rotting, moisture, and the other detrimental effects of the subterranean environment, thereby helping to preserve the post attached to the base. The shield helps to protect the post from termites and other pests. The shield may include a spacer that increases the distance between the post and the remainder of the base. The shell protects concrete or other massive material contained therein. Constructing the base with a shell also provides a uniform configuration for bases. The device can be light enough for installers to lift and handle, but still provide sufficient support for a post. Indentations in the shell help to hold massive material, for example concrete, securely.

Using the device reduces lumber costs. Fence, lamp, and mailbox posts must be buried to a depth sufficient to provide the required stability. Posts having a suitable length may be expensive, difficult to obtain in adequate supply, and difficult to transport. Using the invention obviates the need to bury a portion of a wooden post in the ground, thus reducing the length of wooden posts needed for a particular construction task.

Because posts are attached to the top of the device, which projects above ground level, the device permits replacement of damaged posts without removing the more environment-resistant base from the ground.

The shell may be manufactured in any desired color. For example, the shell may match the color of the post, or the ground. The shell may be white, green, or an earth tone. The shield may also be manufactured in any color. Designs in which only the shield protrudes above the surface of the ground when in use simplify manufacturing, because only the shield need be made in the desired colors, while the remainder of the device may be made without consideration to color. Manufacture of the shell may be simplified by designing the shell walls to have a uniform thickness.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1A:
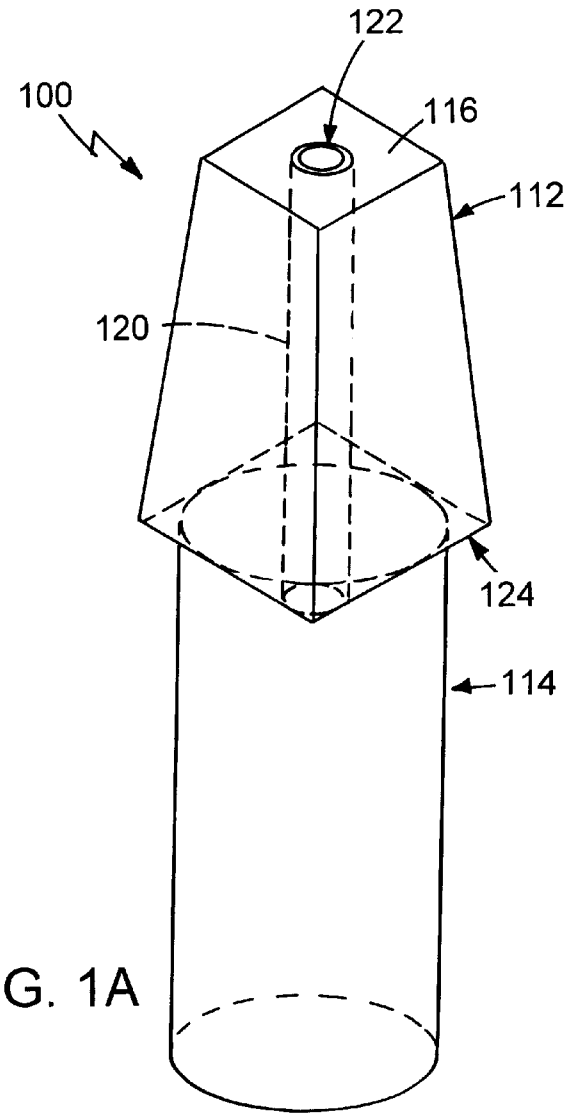
FIG. 1A is a perspective view of a post base.
Figure 1B:
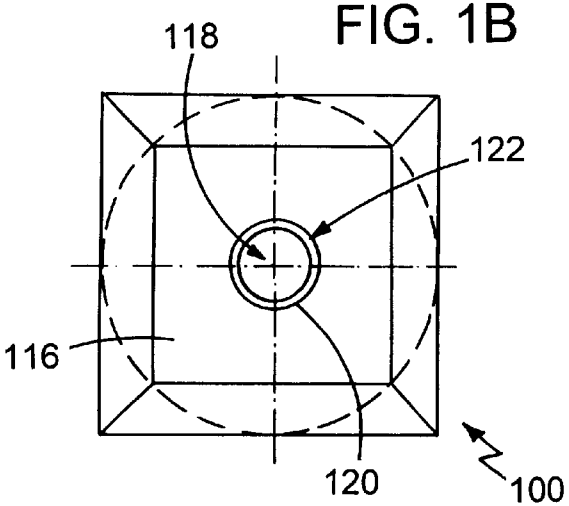
FIG. 1B is a plan view of the base of FIG. 1A.
Figure 1C:
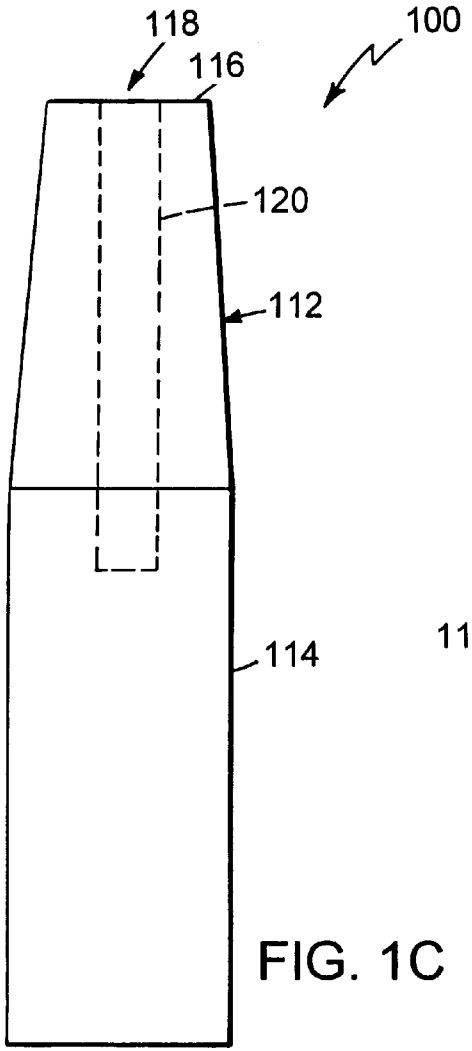
FIG. 1C is a side view of the base of FIG. 1A.

Referring to FIGS. 1A–1C, there is shown a post base 100 having upper tapering portion 112, shaped generally like a truncated pyramid, and lower cylindrical portion 114. Upper tapering portion 112 includes top 116 defining aperture 118 therethrough. Pipe 120 is engaged with inner surface 122 of aperture 118. Upper tapering portion 112 and lower cylindrical portion 114 may be separate elements connected by adhesive, screws, or other suitable fasteners. Preferably, however, upper tapering portion 112 and lower cylindrical portion 114 are integral. Preferably, pipe 120 is made of PVC and secured to at least inner surface 122, e.g., with adhesive, such as glue or epoxy. However, pipe 120 may also be secured to upper tapering portion 112 by friction fit, or with screws, pins, threads, or other fasteners.

Figure 2A:
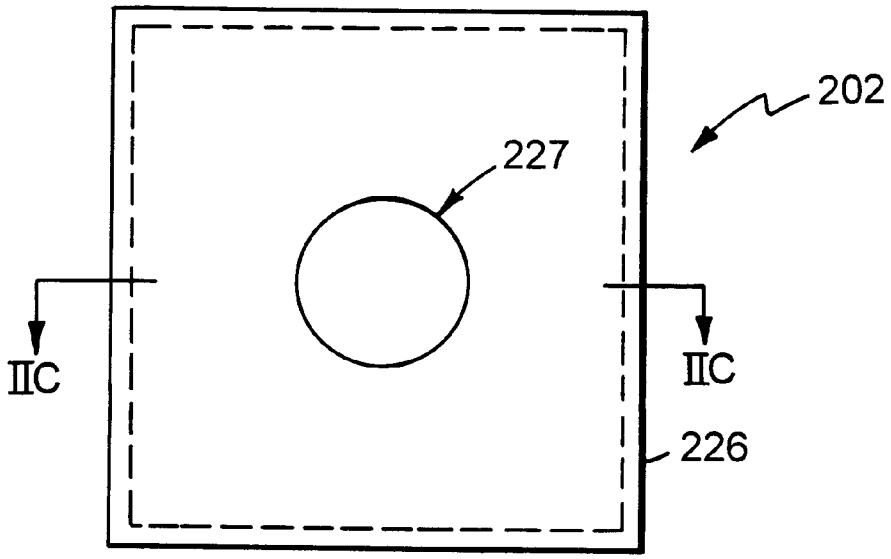
FIG. 2A is a plan view of a shield.
Figure 2B:
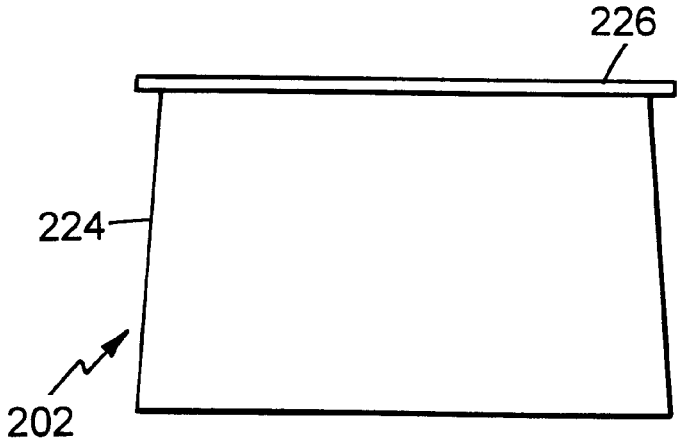
FIG. 2B is a side view of the shield of FIG. 2A.
Figure 2C:
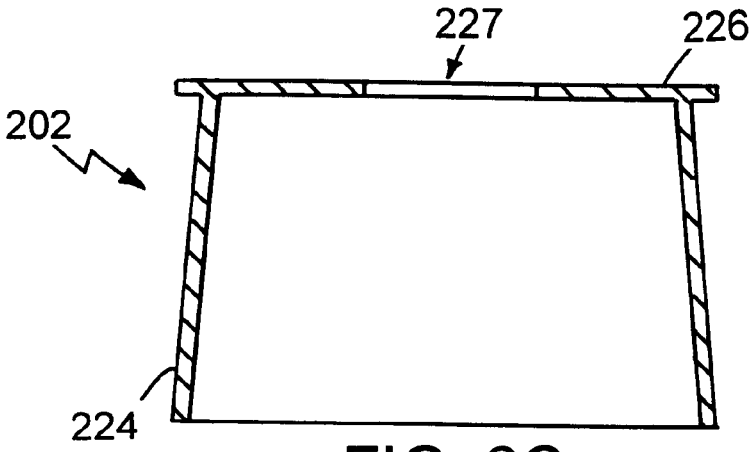
FIG. 2C is a vertical sectional view of the shield of FIG. 2A.

Referring to FIGS. 2A–2C, there is shown a shield 202 for use with post base 100. The shield has shield tapering section 224 and shield top 226. Shield top 226 is sized and shaped to overhang beyond shield tapering section 224, preferably by approximately 0.5 inch. This amount of overhang is effective in deterring termites, but does not substantially detract from the aesthetic appearance of the base. Shield top 226 defines shield aperture 227. The shield is sized to fit on a post base, for example, by engagement with top 116 and upper tapering portion 112 of FIGS. 1A–1C.

Figure 3:
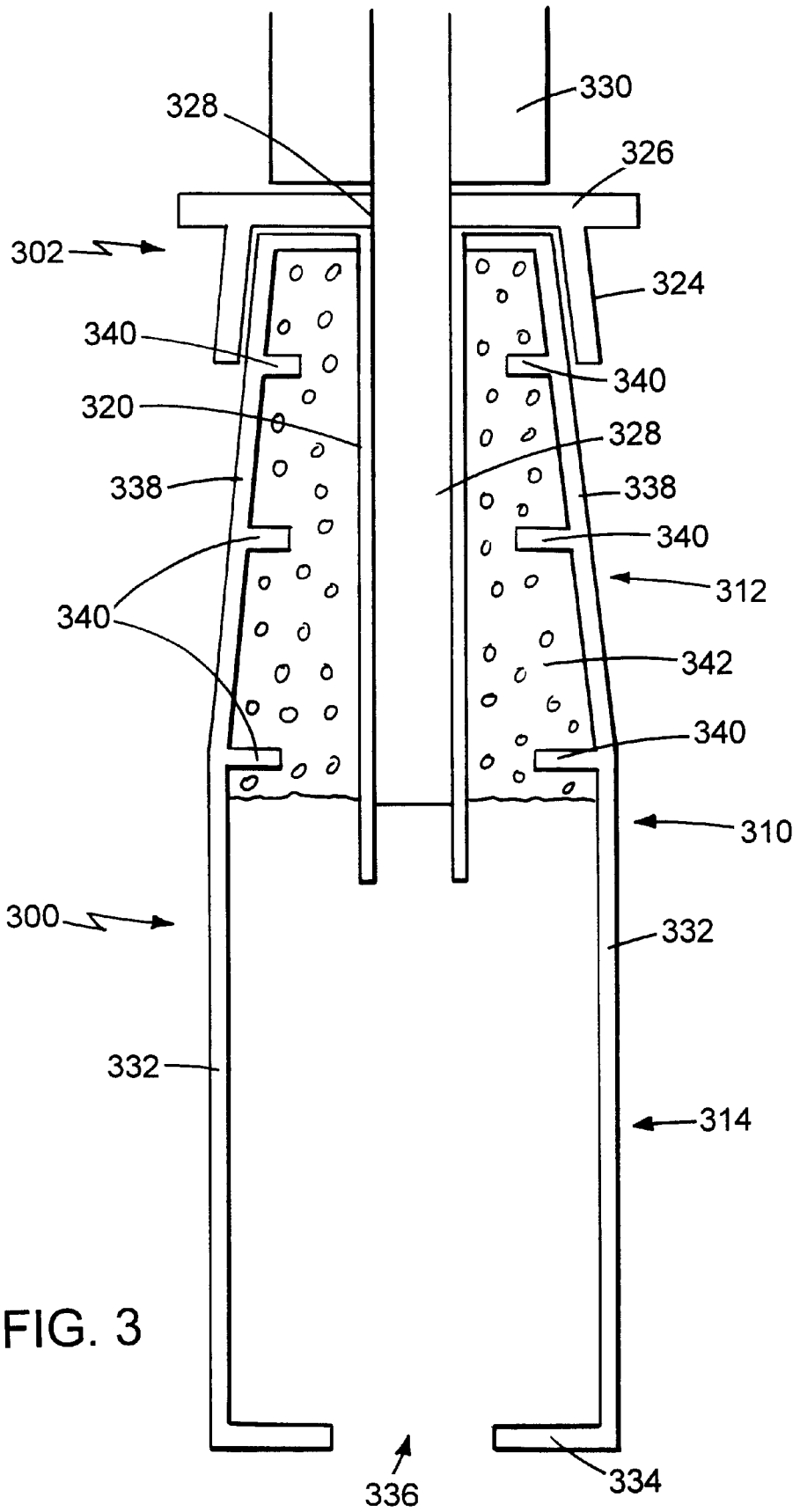
FIG. 3 is a vertical sectional view of a base assembled with a shield and a post.

Referring to FIG. 3, there is shown a base 300 and shield 302 in combination with rod 328 for making connection to post 330 that defines cavity 332. Rod 328 is sized to fit within pipe 320 and through shield aperture 327. Rod 328 is also sized to fit within cavity 332. Rod 328 may be secured to pipe 320 or post 330 with epoxy or other adhesive, or with any other fastening technique, such as with pins, screws, or a threaded interconnection.

FIG. 3 also shows that non-tapering walls 332 of non-tapering cylindrical portion 314 extend inwardly at their lower extremity to form bottom 334 that defines bottom opening 336 having a smaller diameter than that of cylindrical portion 314.

As seen in FIG. 3, tapering walls 338 of upper tapering portion 312 have inwardly-projecting baffles 340. Baffles 340 extend inwardly, e.g., approximately 0.5 inch, and are about 0.25 inch thick. Baffles 340 engage concrete 342 within upper tapering portion 312. Concrete 342 may be filled to any desired level. Preferably, upper tapering portion 312 is at least partially filled with concrete 342. Lower cylindrical portion 314 may also be filled with concrete 342, either fully or partially.

Figure 4B:
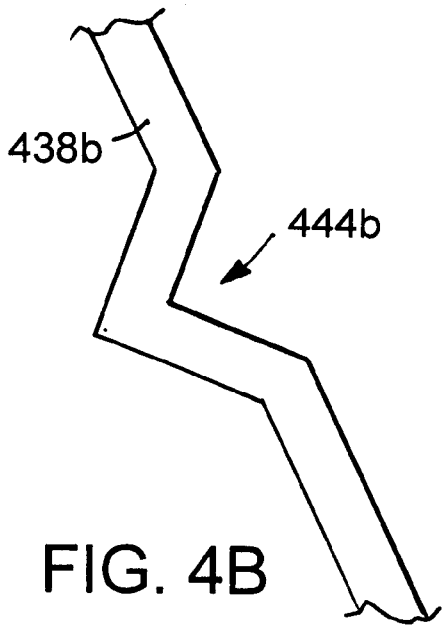
FIG. 4B is partial vertical sectional view of an alternative base shell.
Figure 4A:
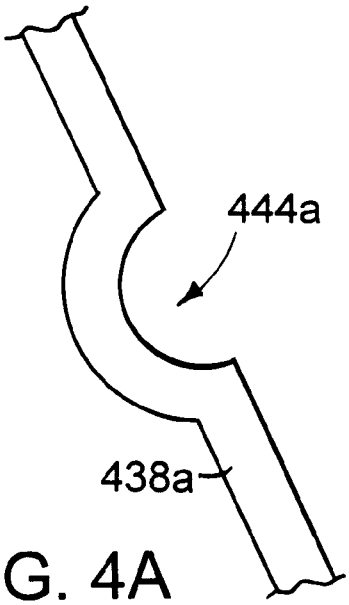
FIG. 4A is partial vertical sectional view of an alternative base shell.
Figure 4C:
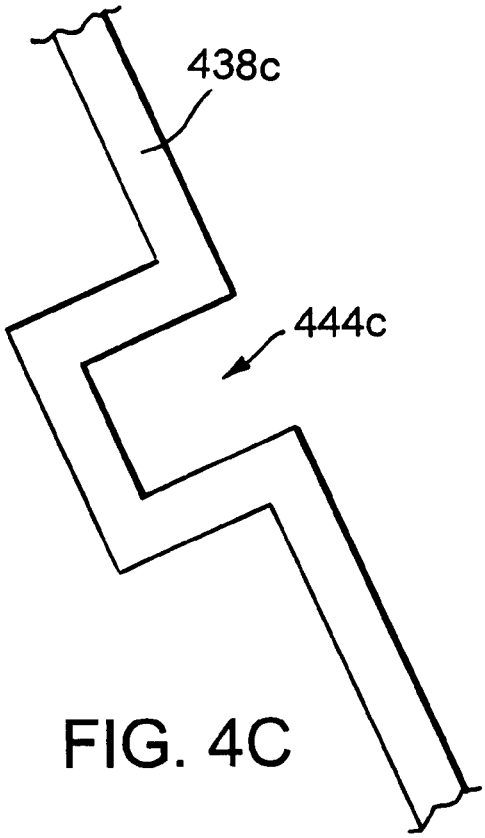
FIG. 4C is partial vertical sectional view of an alternative base shell.

In alternative embodiments, instead of baffles 340, the walls of the upper tapering portion may be contoured, so that the walls have a uniform thickness. FIG. 4A shows first alternative walls 438*a* having curved contours 444*a*. FIGS. 4B and 4C, respectively, show second alternative walls 438*b* and third alternative walls 438*c* having angular contours 444*b* and 444*c*.

Figure 5:
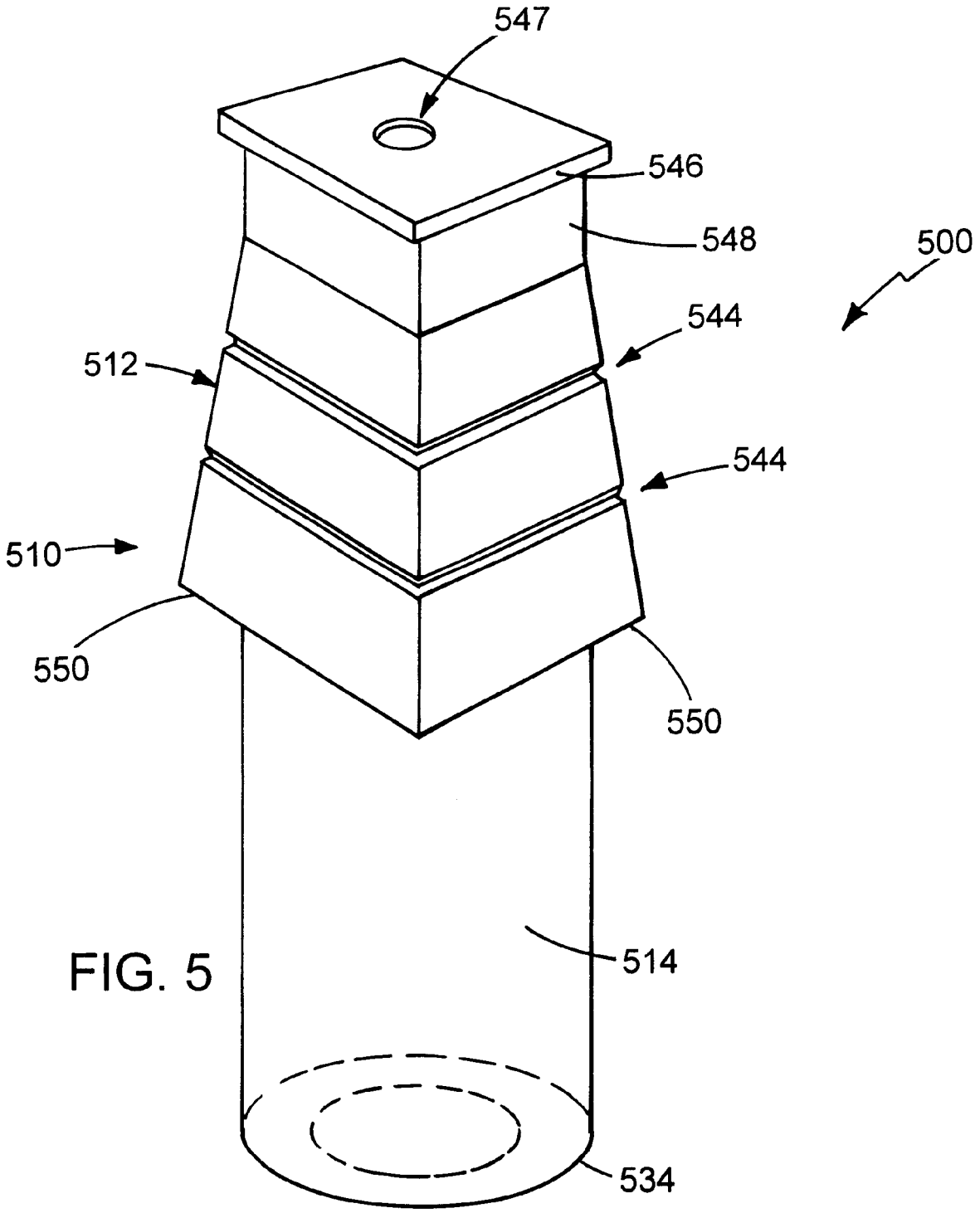
FIG. 5 is a perspective view of an alternative base and shield.

Referring to FIG. 5, there is shown a post base 500 having shell 510 with alternative shield top 546, prismatic portion 548, upper tapering portion 512, and lower cylindrical portion 514. Upper tapering portion 512 is shaped generally like a truncated pyramid. Preferably, alternative shield top 546 and prismatic portion 548 are integral with upper tapering portion 512. Alternative shield top 546 is substantially square and defines alternative shield aperture 547 therethrough. Alternative shield aperture 547 is sized to receive a rod for a connection with a post. Upper tapering portion 512 defines angled contours 544. Lower cylindrical section includes bottom 534. As shown, spacer 548 does not taper, although its sides may be tapering, in other alternative embodiments. Preferably, upper tapering portion 512 and lower cylindrical portion 514 are integral and without open regions under corners 550. Preferably, upper tapering portion 512, alternative shield top 546, and lower cylindrical portion 514 are made of PVC and shell 510 is at least partially filled with a massive material, such as concrete.

Figure 6C:
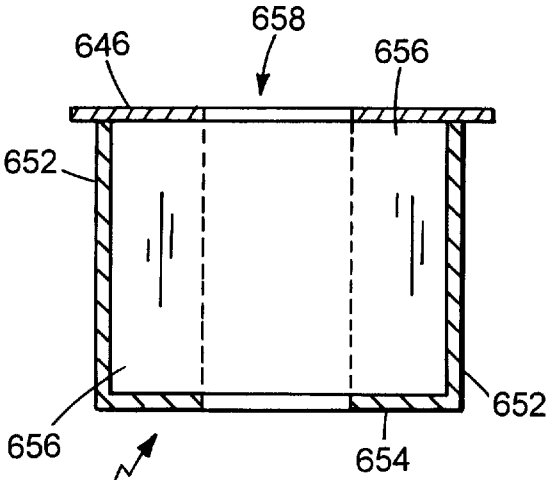
FIG. 6C is a vertical sectional view of an alternative shield.
Figure 6B:
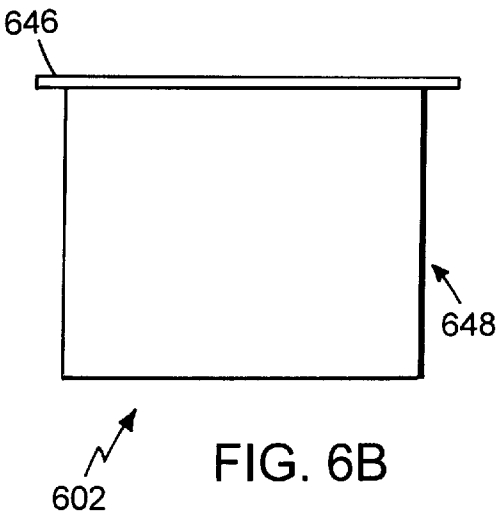
FIG. 6B is a side view of an alternative shield.
Figure 6A:
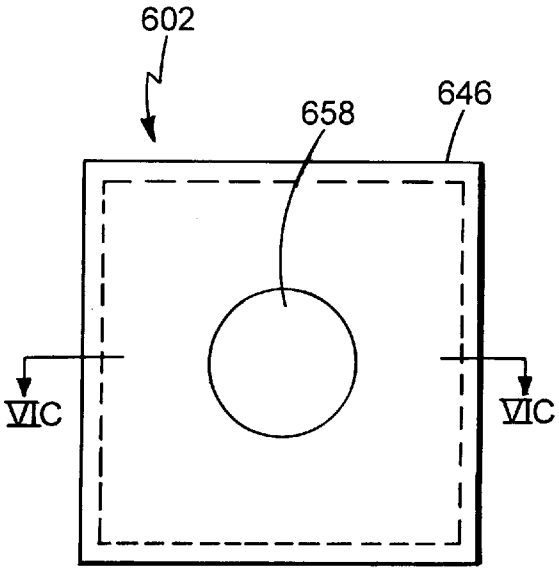
FIG. 6A is a plan view of an alternative shield.

FIGS. 6A–6C show an alternative shield 602 similar to that seen in FIG. 5. The alternative shield has alternative shield top 646, prismatic spacer 648, spacer walls 652, spacer bottom 654, and spacer support member 656. Alternative shield top 646, spacer 648, and spacer bottom 654 define passage 658 therethrough. Passage 658 is sized to accommodate a rod used to connect the base to a post. Alternative shield top 646 overhangs spacer 648 by approximately 0.5 inch. Preferably, spacer support member 656 has the form of a honeycomb material, although spacer 648 may be solid or filled with any other supportive material. Depending on the strength and rigidity of spacer walls 652, spacer support member 656 may be omitted altogether.

Preferably, the shield and shell are formed of PVC approximately 0.125 inch thick and manufactured in any color suitable for landscape construction, such as the color of the associated post or fencing (white, for example), grass (green), or in an earth tone.

The base may have any dimensions suitable to accommodate a particular post. For posts that are 4.5 to 5.5 inches wide, it is preferred that the upper tapering portion is 14 inches long with maximum width of approximately 8 inches that tapers to approximately 5.5 inches. Preferably, the lower non-tapering portion is roughly 20 inches long and 8 inches wide. Shells and the pipe attached to the upper portion should typically be approximately 21 inches long with an outer diameter of 2 inches. Shields are preferably about 4 inches high, whether designed to fit over a base or to include a spacer.

A number of embodiments of the invention have been described. Nevertheless, it will be understood that various modifications may be made without departing from the spirit and scope of the invention. For example, in embodiments that include a shell, the shell may only cover a portion of the exterior, such as only the tapered portion. Additionally, the shell may be made of any suitable materials, including plastics, metals, and ceramic materials. Further, the upper tapered portion may be integral with the shield. Accordingly, other embodiments are within the scope of the following claims.

What is claimed is:

1. A post base comprising:

an upwardly-tapering portion;

a shell surrounding said upwardly-tapering portion, said shell defining a top outer surface; and a shield mounted to said top outer surface of said shell, said shield projecting laterally beyond said top outer surface.

2. The post base of claim 1 wherein said shield is integral with said shell.

3. The post base of claim 1 wherein said shield comprises a first shield portion projecting laterally beyond said top outer surface and a second shield portion projecting downwardly relative to said top outer surface.

4. The post base of claim 1, further comprising a non-tapering portion adjacent to said upwardly-tapered portion, wherein said non-tapering portion is disposed generally below said upwardly-tapering portion.

5. The post base of claim 4 wherein said non-tapering portion is defined by said shell.

6. The post base of claim 4 wherein said non-tapering portion is surrounded by said shell.

7. The post base of claim 5, further comprising a bottom surface defined by said shell.

8. The post base of claim 1, further comprising a post mounted to said upwardly-tapering portion.

9. The post base of claim 1 wherein said top outer surface defines an opening and said post base further comprises a downwardly-extending pipe engaged therewithin, said pipe being sized to receive a rod.

10. A post base comprising:

an upwardly-tapering upper portion comprising a first shell portion, said first shell portion comprising a base top defining an outer surface;

a non-tapering lower portion connected to said upper portion; and a shield having a shield top extending laterally beyond said base top.

11. The post base of claim 10 further comprising a shield spacer disposed generally between said shield top and said upwardly tapering upper portion.

12. The post base of claim 10 wherein said shield is integral with said base top.

13. The post base of claim 10 wherein said shield has an earth tone color.

14. The post base of claim 10 wherein said shield has a white color.

15. The post base of claim 10 wherein said upwardly-tapering upper portion has a cross-sectional shape having at least one flat side.

16. The post base of claim 15 wherein said cross-sectional shape is a quadrilateral.

17. The post base of claim 16 Wherein said cross-sectional shape is substantially a square.

18. The post base of claim 10 wherein said non-tapering lower portion is substantially cylindrical.

19. The post base of claim 10 wherein said non-tapering lower portion comprises a second shell portion.

20. The post base of claim 19 wherein said first shell portion joined is with said second shell portion.

21. The post base of claim 20 wherein said first shell portion and said second shell portion are integral.

22. A post base comprising:

an upwardly-tapering upper portion comprising a first shell portion;

a non-tapering lower portion connected to said upper portion;

a massive material at least partially filling said first shell portion; and inwardly-directed projections, defined by said first shell portion, said inwardly-directed projections being engaged with cooperating indentations in said massive material.

23. The post base of claim 22 wherein said inwardly-directed projections comprise baffles.

24. The post base of claim 22 wherein said inwardly-directed projections comprise contours in said first shell portion.

25. The post base of claim 24 wherein said inwardly-directed projections are rounded.

26. The post base of claim 24 wherein said inwardly-directed projections are angular.

27. A post base for a wooden post comprising:

a shell having an upwardly-tapering upper portion and a non-tapering lower portion, said upper portion having interior surface defining contours;

a massive material associated with said upper portion; and a shield associated with and projecting laterally from said upper portion.

28. The post base of claim 27, further comprising an inwardly-directed projection on an interior surface of said upper portion and cooperation indentation in said massive material, said inwardly-directed projection being engaged in said indentation.

29. The post base of claim 27 wherein said upwardly-tapering upper portion is shaped substantially like a truncated pyramid.

30. The post base of claim 27 wherein said non-tapering lower portion is substantially cylindrical.

* * * * *